US005765755A

United States Patent [19]

Peters et al.

[11] Patent Number: 5,765,755

[45] Date of Patent: Jun. 16, 1998

[54] INJECTION RATE SHAPING NOZZLE ASSEMBLY FOR A FUEL INJECTOR

[75] Inventors: Lester L. Peters; Julius P. Perr; A. S. Ghuman; Benjamin M. Yen, all of Columbus; Chad L. Buchanan, Westport; Robert Samuel, Columbus; Kevin L. Vogt, Columbus; John T. Carroll, III, Columbus; James E. Denton, Columbus; David E. Schisler, Columbus, all of Ind.

[73] Assignee: Cummins Engine Company, Inc., Columbus, Ind.

[21] Appl. No.: 787,963

[22] Filed: Jan. 23, 1997

[51] Int. Cl.[6] ..... B05B 9/00; F02M 47/02

[52] U.S. Cl. ..... 239/124; 239/90; 239/533.4

[58] Field of Search ..... 239/88, 90, 91, 239/92, 96, 124, 125, 533.1, 533.2, 533.3, 533.9

[56] References Cited

U.S. PATENT DOCUMENTS

| | | | |
|---|---|---|---|
| 2,959,360 | 11/1960 | Nichols . | |
| 3,241,768 | 3/1966 | Croft | 239/124 |
| 3,379,374 | 4/1968 | Mekkes . | |
| 3,669,360 | 6/1972 | Knight . | |
| 3,718,283 | 2/1973 | Fenne . | |
| 3,747,857 | 7/1973 | Fenne . | |
| 3,817,456 | 6/1974 | Schlappkohl . | |
| 3,836,080 | 9/1974 | Butterfield et al. | 239/96 |
| 4,258,883 | 3/1981 | Hofmann et al. . | |
| 4,361,360 | 11/1982 | Kuether . | |
| 4,804,143 | 2/1989 | Thomas . | |
| 4,811,715 | 3/1989 | Djordjevic et al. . | |
| 4,889,288 | 12/1989 | Gaskell . | |
| 4,993,926 | 2/1991 | Cavanagh . | |
| 5,020,500 | 6/1991 | Kelly . | |
| 5,029,568 | 7/1991 | Perr . | |
| 5,133,645 | 7/1992 | Crowley et al. . | |
| 5,242,118 | 9/1993 | Schmidt et al. | 239/533.9 X |
| 5,421,521 | 6/1995 | Gibson et al. . | |
| 5,647,536 | 7/1997 | Yen et al. | 239/90 |

FOREIGN PATENT DOCUMENTS

| | | |
|---|---|---|
| 397289 | 3/1994 | Austria . |
| 759420 | 8/1940 | Germany . |
| 450866 | 2/1949 | Italy . |
| 55-30997 | 2/1980 | Japan . |
| 58-59365 | 4/1983 | Japan . |
| 61-145352 | 7/1986 | Japan . |
| 62-223454 | 10/1987 | Japan . |
| 63-158580 | 10/1988 | Japan . |
| 2-96465 | 8/1990 | Japan . |
| 4-292569 | 10/1992 | Japan . |

*Primary Examiner*—Andres Kashnikow
*Assistant Examiner*—Robin O. Evans
*Attorney, Agent, or Firm*—Sixbey, Friedman, Leedom & Ferguson; Charles M. Leedom, Jr.; Tim L. Brackett, Jr.

[57] ABSTRACT

An injection rate shaping nozzle assembly for a fuel injector is provided which includes a closed nozzle valve element and a rate shaping control device including an injection spill circuit for spilling a portion of the fuel to be injected to produce a predetermined time varying change in the flow rate of fuel injected into a combustion chamber. The spill circuit includes a spill passage integrally formed in the nozzle valve element. The rate shaping control device may include a spill accelerating chamber in formed in the nozzle valve element for creating a rapid increase in the spill flow rate. A spill circuit purge device is provided to remove fuel from the spill circuit and accelerating chamber between each of the injection events thereby ensuring an unimpeded, effective spill fuel flow during the next spill event. The purge device includes a purge passage formed of a predetermined size for restricting the flow of purge gas to ensure sufficient fuel removal from the injection spill circuit while avoiding excessive purge gas flow. The purge passage may include an annular clearance gap formed between the nozzle valve element and the nozzle housing wall, or alternatively, may include an orifice passage formed in the inner portion of the nozzle valve element. An improved method for forming a nozzle valve element having an axial center passage is also disclosed.

39 Claims, 11 Drawing Sheets

INJECTION RATE SHAPING NOZZLE ASSEMBLY FOR A FUEL INJECTOR

TECHNICAL FIELD

This invention relates to an improved nozzle assembly for fuel injectors which effectively controls the flow rate of fuel injected into the combustion chamber of an engine.

BACKGROUND OF THE INVENTION

In most fuel supply systems applicable to internal combustion engines, fuel injectors are used to direct fuel pulses into the engine combustion chamber. Fuel injection into the cylinders of an internal combustion engine is most commonly achieved using either a unit injector system or a fuel distribution type system. In the unit injector system, fuel is pumped from a source by way of a low pressure rotary pump or gear pump to high pressure pumps, known as unit injectors, associated with corresponding engine cylinders for increasing the fuel pressure while providing a finely atomized fuel spray into the combustion chamber. Such unit injectors conventionally includes a positive displacement plunger driven by a cam which is mounted on an engine driven cam shaft. The fuel distribution type system, on the other hand, supplies high pressure fuel to injectors which do not pump the fuel but only direct and atomize the fuel spray into the combustion chamber.

A commonly used injector in both the unit and fuel distribution systems is a closed-nozzle injector. Closed-nozzle injectors include a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block the nozzle orifices. When the pressure of the fuel within the nozzle cavity exceeds the biasing force of the nozzle spring, the nozzle valve element moves outwardly to allow fuel to pass through the nozzle orifices. Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices or modifications in or adjacent to the fuel injector nozzle assemblies. One method of controlling the initial rate of fuel injection is to spill a portion of the fuel to be injected during the injection event. For example, U.S. Pat. Nos. 4,811,715 to Djordjevic et al. and 3,747,857 to Fenne each disclose a fuel delivery system for supplying fuel to a closed nozzle injector which includes an expandable chamber for receiving a portion of the high pressure fuel to be injected. The diversion or spilling of injection fuel during the initial portion of an injection event decreases the quantity of fuel injected during this initial period thus controlling the rate of fuel injection. A subsequent unrestricted injection flow rate is achieved when the expandable chamber becomes filled causing a dramatic increase in the fuel pressure in the nozzle cavity. Therefore these devices rely on the volume of the expandable chamber to determine the beginning of the unrestricted flow rate. Moreover, the use of a separate expandable chamber device mounted on or near an injector increases the costs, size and complexity of the injector. U.S. Pat. No. 5,029,568 to Perr discloses a similar injection rate control device for an open nozzle injector.

U.S. Pat. No. 4,804,143 to Thomas discloses another fuel injector nozzle assembly incorporating a passage in the nozzle assembly for diverting the fuel from the nozzle assembly. The injection nozzle unit includes a restricted passage formed in the injector adjacent the nozzle valve element for directing fuel from the nozzle cavity to a fuel outlet circuit. However, the restricted passage is used to maintain fuel flow through the nozzle unit so as to effect cooling. The Thomas patent nowhere discusses or suggests the desirability of controlling the injection rate. Moreover, the restricted passage is closed by the nozzle valve element upon movement from its seated position to prevent diverted flow during injection.

U.S. Pat. No. 4,993,926 to Cavanagh discloses a fuel pumping apparatus including a piston having a passage formed therein for connecting a chamber to an annular groove for spilling fuel during an initial portion of an injection event. The piston includes a land which blocks the spill of fuel after the initial injection stage to permit the entirety of the fuel to be injected into the engine cylinder. However, this device is incorporated into a piston pump positioned upstream from an injector.

Another method of reducing the initial volume of fuel injected during each injection event is to reduce the pressure of the fuel delivered to the nozzle cavity during the initial stage of injection. For example, U.S. Pat. No. 5,020,500 to Kelly discloses a closed nozzle injector including a passage formed between the nozzle valve element and the inner surface of the nozzle cavity for restricting or throttling fuel flow to the nozzle cavity so as to provide rate shaping capability. U.S. Pat. No. 4,258,883 issued to Hofmann et al. discloses a similar fuel injection nozzle including a throttle passage formed between the nozzle valve element and a separate control supply valve for restricting fuel flow into the nozzle cavity thus limiting the pressure increase in the cavity and the rate of injection fuel flow through the injector orifices. However, the devices disclosed in both Kelly and Hofmann et al. require extremely close manufacturing tolerances which must be carefully controlled to create a throttling passage having the precise dimensions necessary to achieve effective, predictable rate shaping. As a result, because of the great difficulty associated with holding very close manufacturing tolerances, these devices greatly increase manufacturing costs. Moreover, this tolerance problem makes the production of fuel injectors having substantially identical characteristics both technically and economically unfeasible.

U.S. Pat. Nos. 3,669,360 issued to Knight, 3,747,857 issued to Fenne, and 3,817,456 issued to Schlappkohl all disclose closed nozzle injector assemblies including a high pressure delivery passage for directing high pressure fuel to the nozzle cavity of the injector and a throttling orifice positioned in the delivery passage for creating an initial low rate of injection. Moreover, the devices disclosed in Knight and Schlappkohl include a valve means operatively connected to the nozzle valve element which provides a substantially unrestricted flow of fuel to the nozzle cavity upon movement of the nozzle valve element a predetermined distance off its seat.

U.S. Pat. Nos. 3,718,283 issued to Fenne and 4,889,288 issued to Gaskell disclose fuel injection nozzle assemblies including other forms of rate shaping devices. For example, Fenne '283 uses a multi-plunger and multi-spring arrangement to create a two-stage rate shaped injection. The Gaskell reference uses a damping chamber filled with a damping fluid for restricting the movement of the nozzle valve element.

An improved injector nozzle assembly for effectively controlling the flow rate of fuel injected is disclosed in co-pending U.S. patent application Ser. No. 376,417, filed Jan. 23, 1995, now U.S. Pat. No. 5,647,536 entitled *Injection Rate shaping Nozzle Assembly for a Fuel Injector*, and commonly assigned to Cummins Engine Co., Inc. The low cost, compact nozzle assembly disclosed in the '417 application includes a spring-biased needle valve having an integrally formed spill passage for controllably spilling fuel during injection events to thereby optimally minimize engine emissions. The nozzle assembly disclosed in the '417 application is of the valve-covered orifice type (VCO nozzle assembly) wherein the needle valve covers or blocks the injection orifices when in the closed position. Another type of conventional nozzle assembly is the "sac" or "mini-sac" type wherein the tip of the injector includes a sac or pocket between the valve element/seat and the injector orifices. In both the VCO and mini-sac type nozzle assemblies incorporating the rate shaping spill technology of the '417 application, the presence of fuel in the needle spill passage subsequent to a given spill/injection event, hinders the flow of fuel through the spill passage during the following injection event thereby preventing optimum injection rate shaping.

U.S. Pat. No. 2,959,360 to Nichols discloses a nozzle valve element having an axial passage formed therein and a cross passage connecting the inner end of the axial passage to the nozzle cavity for diverting fuel from the nozzle cavity into an expansible chamber formed in the nozzle valve element. A plunger is positioned in the chamber to form a differential surface creating a fuel pressure induced seating force on the nozzle valve element to aid in rapidly seating the valve element. This system appears to be of the "mini-sac" design since it includes a smaller, coaxial duct positioned between the nozzle valve seat and the injector orifices. Also, U.S. Pat. No. 3,379,374 to Mekkes is noted for disclosing a closed nozzle injector including a valve element having an axial passage and a plurality of cross passages. However, the passages, formed in the valve elements of the Nichols and Mekkes devices, supply fuel for injection. Moreover, neither reference suggests the desirability of controlling the rate of injection.

U.S. Pat. No. 5,421,521 to Gibson et al. discloses a fuel injection nozzle assembly including a needle element having an axial passage integrally formed therein for directing fuel, during an injection event, from the orifice end of the assembly to the actuator end. The tip portion of the valve element has an outer diameter which is slightly less than the diameter of the opposing injector tip wall so that a leakage path is established for fuel flow to the axial passage during an injection event. This arrangement is designed to balance the hydraulic forces on the element in the open position and, therefore, Gibson et al. no where suggest any form of fuel injection rate shaping during each injection event.

Italian Patent No. 450,866 discloses a closed nozzle injector including a needle valve element having a passage formed therein for directing fuel to a pressure chamber formed by a piston. This arrangement is designed to cause the needle valve element to open during an initial stage, then momentarily close to interrupt injection, and subsequently reopen to continue injection thereby carrying out injection in two separate stages. The fuel pressure in the pressure chamber, formed by a spring loaded piston positioned in the needle valve element, necessarily increases to a high level to cause the closing of the needle valve element and thus the separate stages of injection. This reference fails to disclose a low pressure drain circuit for receiving fuel spilling from an injection spill circuit during the injection event so as to create a low injection flow rate followed by a high injection flow rate during the injection event. A fuel outlet extending from a spring chamber provides a leak-off path for fuel leaking by clearances between the piston elements and the nozzle body and does not function to control the injection characteristics of the valve.

U.S. Pat. No. 5,133,645 to Crowley et al. discloses a nozzle valve assembly including passages for directing fuel from the nozzle cavity to a drain during injection wherein a stop formed on the needle valve element throttles the drain flow during injection. However, this arrangement is used to create a pressure differential across the nozzle valve element to initiate injection and, therefore, Crowley et al. no where suggest controlling the rate of fuel injection.

German Patent Document No. 759,420 discloses a closed nozzle injector nozzle needle including an integral passage used to return leak-by fuel from the spring chamber to the interior of the atomizer head adjacent the injection orifices for injection into the combustion chamber. In this manner, fuel leaking through the slidable clearance formed between needle and nozzle body into the spring chamber is returned for injection. This reference fails to suggest the desirability of controlling the rate of injection.

Consequently, there is a need for a fuel injector incorporating a simple, cost effective rate shaping device which minimizes the complexity of the nozzle assembly while controlling emissions by effectively controlling the rate of fuel injection during each injection event.

SUMMARY OF THE INVENTION

It is an object of the present invention, therefore, to overcome the disadvantages of the prior art and to provide an improved nozzle assembly for a fuel injector which effectively controls the flow rate of fuel injected into the combustion chamber of an engine so as to minimize engine emissions.

It is another object of the present invention to provide both a valve covered orifice (VCO) type and a mini-sac type nozzle assembly capable of shaping the rate of fuel injection which are also simple and inexpensive to manufacture.

It is yet another object of the present invention to provide a rate shaping nozzle assembly for an injector which effectively slows down the rate of fuel injection during the initial portion of an injection event while subsequently increasing the rate of injection to rapidly achieve a high injection pressure.

It is a further object of the present invention to provide both a VCO and a mini-sac type rate shaping nozzle assembly for an injector including a nozzle valve element having a spill passage wherein fuel is effectively purged from the spill passage between each injection event to ensure effective control of the rate of injection.

It is a still further object of the present invention to provide both a VCO and a mini-sac type rate shaping nozzle assembly for an injector including a nozzle valve element having a spill passage which provides an optimum amount of purge gas flow through the spill circuit to remove spill fuel while preventing an unnecessary amount of purge gas flow.

Still another object of the present invention is to provide a rate shaping nozzle assembly for an injector which includes a spill circuit through which fuel flow is prevented when the nozzle valve element is closed between injection events.

Yet another object of the present invention is to provide a mini-sac type injector assembly including a spill circuit for spilling fuel to create a low injection flow rate followed by a high injection flow rate while providing a purge gas flow for effectively removing a substantial portion of the fuel in the spill circuit before each injection event to ensure proper injection rate shaping while restricting the purge gas flow to an acceptable level.

Another object of the present invention is to provide a rate shaping assembly having a spill circuit which effectively controls the rate of fuel injection while preventing the accumulation of gas or air bubbles in the spill circuit.

A further object of the present invention is to provide a simple, inexpensive method for forming a rate shaping nozzle valve element having an integral spill passage.

Still another object of the present invention is to provide a method for forming a rate shaping nozzle valve element having an integral spill passage which minimizes manufacturing costs, minimizes material removal by turning and grinding, eliminates an electro-discharge machining (EDM) "white" layer in highly stressed regions, minimizes EDM machining distances, maximizes material selection options, maximizes the available spill void volume while maintaining a high degree of rotational symmetry, and provides part handling and processing efficiencies.

These and other objects are achieved by providing a closed nozzle fuel injector comprising an injector body containing an injector cavity communicating with an injector orifice for discharging fuel into a combustion chamber wherein the injector body includes a fuel transfer circuit for transferring supply fuel to the orifice and a low pressure drain circuit for draining fuel from the injector cavity. A nozzle valve element positioned in the injector cavity adjacent the injector orifice is movable between an open position in which fuel may flow from the transfer circuit through the orifice into the combustion chamber, and a closed position in which fuel flow through the injector orifice is blocked. The nozzle valve element moves from the closed position to the open position and back to the closed position to define an injection event. The injector includes a rate shaping control device for producing a predetermined time varying change in the flow rate of fuel injected into the combustion chamber during the injection event. The rate shaping control device includes an injection spill circuit for spilling a portion of the injection fuel from the transfer circuit to the low pressure drain circuit during the injection event. The closed nozzle fuel injection further includes a spill circuit purge device for providing a flow of purge gas through the injection spill circuit so as to remove fuel from the spill circuit between injection events. The purge device is capable of restricting the flow of purge gas to ensure sufficient fuel removal from the spill circuit while avoiding excessive purge gas flow. The spill circuit purge device may include a cylinder gas purge passage for directing cylinder gas from the combustion chamber of the engine into a spill passage formed in the nozzle valve element.

The cylinder gas purge passage may be formed between the nozzle valve element and the injector body for directing cylinder gas from the injector orifice to the spill passage. The valve element may include an inner portion having a frusto-conically shaped valve surface while the injector body may include a nozzle housing having a frusto-conically shaped seating surface facing the valve surface. The valve surface and the seating surface may extend at different angles relative to the nozzle valve element center line so as to be positioned in a nonparallel relationship. As a result, the cylinder gas purge circuit includes an annular clearance gap formed between the valve surface and the seating surface created by the nonparallel relationship, and sized, when the nozzle valve element is in the closed position, to restrict the purge gas flow to achieve a predetermined optimum purge gas flow.

The spill passage may include at least one axial passage extending longitudinally from an inner portion of the nozzle valve element to an outer portion. The spill passage may further include a plurality of connector passages extending from the axial passage through the inner portion of the nozzle valve element to communicate with the cylinder gas purge passage. The plurality of connector passages may include three passages evenly spaced around the nozzle valve element. The connector passages may also extend perpendicular to the axial spill passage or at an angle toward the injection orifice. A transverse passage, functioning as a spill acceleration device, may be provided in the outer portion of the nozzle valve element. The axial passage may be formed from the inner end of the nozzle valve element so that the outer end of the axial passage terminates at the transverse passage while the inner end of the axial passage includes a sealing plug. Alternatively, the axial spill passage may be formed from the outer end of the nozzle valve element and a sealing plug positioned in the outer end while the inner end of the passage terminates at, and communicates with, the plurality of connector passages in the inner portion of the nozzle valve element.

The nozzle valve element may include an axial spill passage positioned a spaced transverse distance from a central longitudinal axis of the nozzle valve element. In this respect, two axial passages may be provided wherein each passage is spaced a respective transverse distance from the central longitudinal axis of the valve element. Whether one or more offset axial passages are provided, the inner end of one or more of the axial passages may form an opening in the valve surface of the nozzle valve element for directly communicating with the cylinder gas purge passage. In another embodiment, the cylinder gas purge passage may include an orifice passage formed integrally in the inner portion of the nozzle valve element for providing communication between an inner end of the spill passage and a mini-sac fuel reservoir formed in the injector body adjacent the injector orifice.

In each of the embodiments, the nozzle valve element may block fuel flow through the spill circuit when positioned in the closed position. The rate shaping control device may include a spill valve for controlling the spill flow of fuel through the spill circuit to create the high injection flow rate. The spill valve may include an annular step integrally formed on the nozzle valve element and an annular valve seat formed on the injector body for sealing engagement by the annular step upon movement of the nozzle valve element into the open position to prevent spill flow through the spill circuit. The rate shaping control device may further include a spill accelerating device positioned along the spill circuit for creating a rapid increase in the spill flow rate during each injection event. The spill accelerating device may include a transverse spill chamber formed in the nozzle valve element and extending generally transverse to the axial passage for receiving spill fuel. The rate shaping control device may include a flow limiting orifice positioned in the spill circuit for limiting the spill flow through the spill passage to a predetermined maximum spill flow rate. The flow limiting orifice is formed at least partially by the nozzle valve element and positioned along the spill circuit downstream of the spill accelerating device.

The present invention is also directed to an improved, less expensive method of forming a nozzle valve element having an axial center spill passage. One embodiment includes the formation of the nozzle valve element from a preformed, i.e. cast, tube having a central passage. A compressive force is applied to the outer surface of the tube, i.e. by roll forming. The central passage may be of the same size as the desired diameter of the spill passage or of a larger diameter which is compressed to the desired final size. Also, two nozzle valve elements may be formed from a single piece of tube stock using a single compression at the center of the tube length to form each of the valve seat portions. The tube may be formed from the a solid bar or rod wherein the spill passage is drilled from the inner end of the rod and terminates prior to the outer end to avoid leakage possibly experienced by a closed outer end of the spill passage.

DETAILED DESCRIPTION OF THE PREFERRED EMBODIMENT

Throughout this application, the words "inward", "innermost", "outward", and "outermost" will correspond to the directions, respectively, forward and away from the point at which fuel from an injector is actually injected into the combustion chamber of the engine. The words "outer" and "inner" will refer to the portions of the injector or nozzle assembly which are, respectively, farthest away and closest to the engine cylinder when the injector is operatively mounted on the engine.

FIGS. 1–10 disclose various embodiments of the rate shaping nozzle assembly of the present invention for use in fuel injectors of various types. For example, the rate shaping nozzle assembly of the present invention may be adapted for use in an injector designed to receive high pressure fuel from a high pressure source (not shown). Such an injector is disclosed in FIG. 9 of U.S. patent application Ser. No. 376,417, filed Jan. 23, 1995, now U.S. Pat. No. 5,647,536 entitled *Injection Rate Shaping Nozzle Assembly for a Fuel Injector* and assigned to the assignee of the present application, Cummins Engine Co., Inc., and which is hereby incorporated by reference. The rate shaping nozzle assembly of the present invention can certainly be incorporated into other forms of injectors including a unit injector having a high pressure pump plunger incorporated into the injector body.

Figure 1A:
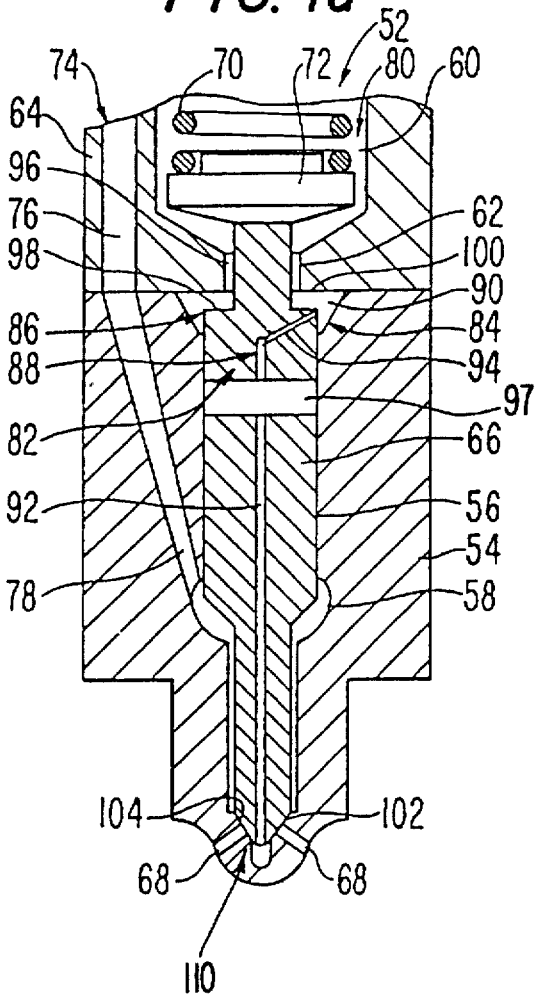
FIG. 1*a* is an enlarged, partial cross-sectional view of the nozzle assembly of a closed nozzle fuel injector incorporating the rate shaping control device of the present invention wherein the nozzle valve element is positioned in the closed position.
Figure 1B:
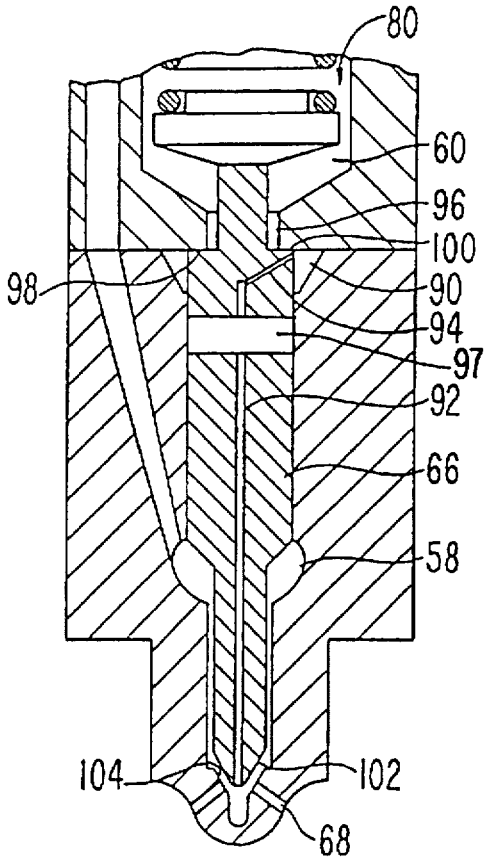
FIG. 1*b* is an enlarged, partial cross-sectional view of the rate shaping nozzle assembly of FIG. 1*a* with the nozzle valve element positioned in the open position.
Figure 2:
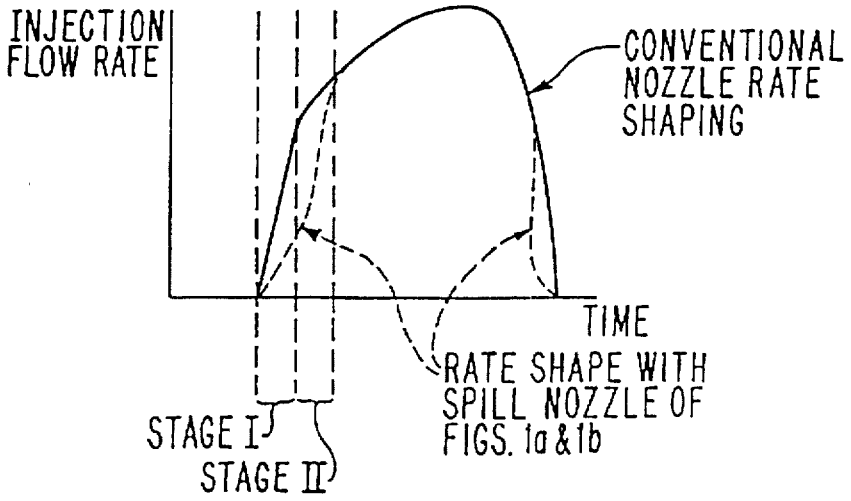
FIG. 2 is a graph showing the injection rate as a function of time during an injection event using the injection rate shaping nozzle assembly of FIGS. 1*a* and 1*b;*

Now referring to FIGS. 1*a* and 1*b*, there is shown the rate shaping nozzle assembly of the present invention indicated generally at 52 which includes a nozzle housing 54 containing a nozzle bore 56 opening into a nozzle cavity 58 at one end. The opposite end of nozzle bore 56 communicates with a spring cavity 60 via a through-hole 62 formed in, for example, an inner barrel 64. Although not shown, a conventional retainer is used to hold the inner barrel and nozzle housing 54 in compressive abutting relationship. Received in nozzle bore 56 is a nozzle valve element 66 sized to form a close sliding fit with the inside surface of bore 56 creating a fluid seal which substantially prevents fluid from leaking from the clearance between nozzle valve element 66 and the inner surface of bore 56. Nozzle valve element 66 is biased into the closed position blocking flow through injector orifices 68 by a biasing spring 70 positioned in spring cavity 60. A connector button 72 functions as a spring seat and also to transmit the spring force to the outer end of nozzle valve element 66. A fuel transfer circuit 74 includes transfer passages 76 and 78 formed in the inner barrel and nozzle housing, respectively, for delivering high pressure fuel from a high pressure source (not shown) to nozzle cavity 58. A low pressure drain circuit 80 communicates with spring cavity 60 to provide a drain path for fuel leakage into spring cavity 60.

Rate shaping nozzle assembly 52 includes a rate shaping control device indicated generally at 82 which includes an injection spill circuit 84 and a spill valve 86. Injection spill circuit 84 includes a spill passage 88 formed integrally in, and extending through, nozzle valve element 66. Injection spill circuit 84 also includes an annular recess 90, through-hole 62, and spring cavity 60. Spill passage 88 includes an axial passage 92 extending from the inner end of nozzle valve element 66, along a central longitudinal axis of nozzle valve element 66, and terminating prior to the outer end of valve element 66. Spill passage 88 also includes a lateral passage 94 extending from the outer end of axial passage 92 to communicate with annular recess 90. Annular recess 90 communicates with spring cavity 60 via an annular clearance 96 formed between the outer end of valve element 66 and through-hole 62. Lateral passage 94 is sized to function as a flow limiting orifice so as to throttle the flow through injection spill circuit 84. Axial passage 92 and lateral passage 94 may be formed by drilling or electrical discharge machining the passages into a fully hardened and finished nozzle element. Also, a spill accelerating device may be provided to create a rapid increase in the spill flow rate at the beginning of the injection event and to minimize the formation of gas pockets along spill circuit 82 which may impair the spill flow. For example, the spill accelerating device may be a transverse chamber 97 extending transversely through nozzle valve element 66 and communicating with axial passage 92. The insertion of nozzle valve element 66 into nozzle housing 54 permits nozzle bore 56 to close the opening of chamber 97 so as to seal the injection spill circuit. The positioning of transverse chamber 97 along spill circuit 84 upstream of lateral orifice passage 94 permits chamber 97 to function effectively as a spill accelerating device while maintaining the flow control function of orifice passage 94. The spill accelerating device may, alternatively, include other large volume passages formed in nozzle valve element 66, such as the embodiments disclosed in U.S. patent application Ser. No. 376,417, filed Jan. 23, 1995, now U.S. Pat. No. 5,647,536 which is hereby incorporated by reference. In addition, instead of lateral passage 94, flats may be formed on the outer surface of nozzle element 66 so as to fluidically connect transverse chamber 97 with annular recess 90 and control the spill flow as disclosed in a co-pending U.S. patent application filed on the same date as the present application in the name of Peters et al. and entitled *Injection Rate Shaping Nozzle Valve Assembly With Outer Spill Flow Restriction*, the entire disclosure of which is hereby by reference.

Spill valve 86 includes an annular step 98 formed on nozzle valve element 66 adjacent annular recess 90. Spill valve 86 also includes an annular valve seat 100 formed opposite step 98 on inner barrel 64. When nozzle valve element 66 is in a closed position as shown in FIG. 1*a* blocking fuel flow through injector orifices 68, annular step 98 is positioned a spaced distance from annular valve seat 100 to provide a spill flow path from annular recess 90 to spring cavity 60 via clearance gap 96. However, during an injection event, when nozzle valve element 66 moves to a fully open position shown in FIG. 1*b*, annular step 98 sealingly engages annular valve seat 100 to prevent spill flow between annular recess 90 and spring cavity 60. Spill passage 88 is formed in nozzle valve element 66 so that the conventional valve arrangement formed on the inner end of element 66 can be used as a spill valve. Specifically, the inner end of nozzle valve element 66 includes a valve surface 102 for sealingly engaging a valve seat 104 formed on the inner surface of nozzle cavity 58 upstream of injector orifices 68. The inner end of axial passage 92 opens relative to valve seat 104 so that nozzle valve element 66 blocks fuel flow from nozzle cavity 58 to axial passage 92 when nozzle valve element 66 is in the closed position against valve seat 104. As a result, no spill fuel flows through spill passage 88 between injection events.

During operation, between injection events, nozzle valve element 66 is positioned in the closed position as shown in FIG. 1*a* blocking flow through injector orifices 68 and injection spill circuit 84. At the start of an injection event, high pressure fuel is delivered from fuel transfer circuit 74 to nozzle cavity 58. When the pressure of the fuel in nozzle cavity 58 reaches a predetermined maximum necessary to overcome the biasing force of spring 70, nozzle valve element 66 begins to lift off valve seat 104 permitting fuel flow from nozzle cavity 58 through fuel injector orifices 68 into the combustion chamber of an engine. Fuel also spills into axial passage 92 traveling outwardly through lateral passage 94 into annular recess 90. During the initial outward movement of the nozzle valve element 66, annular step 98 is still positioned a spaced distance from annular valve seat 100. As a result, fuel flowing into annular recess 90 is permitted to spill through clearance gap 96 into spring cavity 60 and on to the low pressure drain (not shown) connected to spring cavity 60.

Therefore, with the present rate shaping nozzle assembly 52, a portion of the fuel normally flowing through injector orifices 68 is instead directed into spill passage 88. This splitting of the fuel flow into an injection flow and a spill flow during the initial portion of the injection event creates a reduced or low injection rate as represented by Stage I in FIG. 2. The size of the orifice formed in lateral passage 94 or, alternatively, the diameter of lateral passage 94, determines the maximum spill rate to the low pressure drain and thus controls the injection rate through orifices 68. Further outward movement of nozzle valve element 66 into a fully opened position as shown in FIG. 1*b*, causes annular step 98 to sealingly engage annular valve seat 100 blocking fluidic communication between annular recess 90 and annular clearance 96. Thus, once nozzle valve element 66 moves into the fully opened position, spill flow through injection spill circuit 84 is prevented thereby permitting full fuel flow through injector orifices 68. As indicated by Stage II in FIG. 2, blockage of the spill flow causes the injection flow rate through injector orifices 68 to rapidly increase.

At the end of the injection event, when the delivery of high pressure fuel to nozzle cavity 58 has ceased, nozzle valve element 66 begins to move inwardly toward the closed position shown in FIG. 1*a*. During this inward movement, annular step 98 moves away from valve seat 100 permitting spill flow of pressurized fuel from nozzle cavity 58 through injection spill circuit 84. This creation of an additional drain or spill path during the last portion of the injection event causes a rapid decrease in the injection flow rate through orifices 68 since a portion of the fuel is directed through spill circuit 84. This end of injection spill advantageously creates a sharper end to the injection event.

Figure 3:
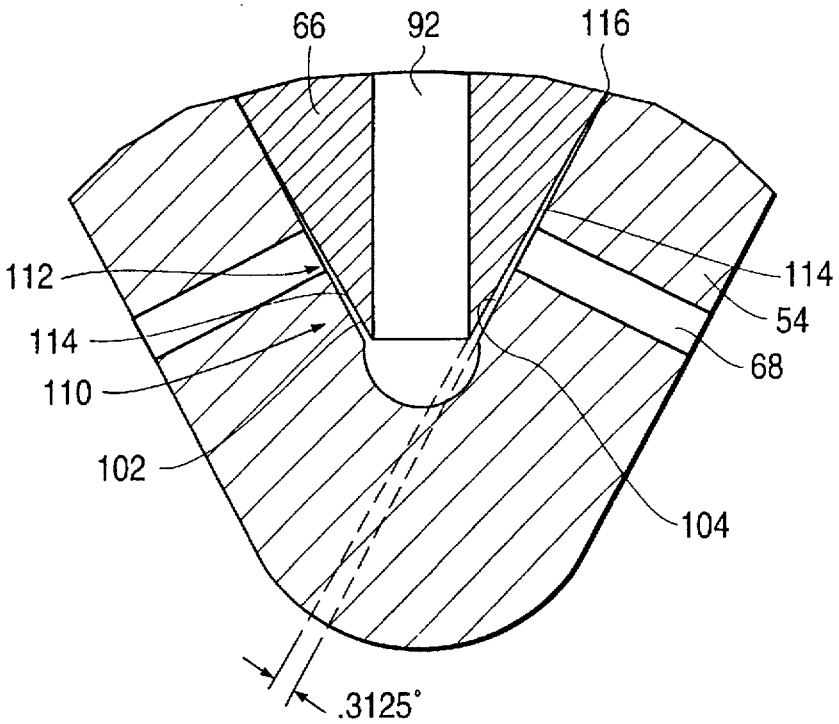
FIGS. 3 is an exploded partial cross-sectional view of the tip of the nozzle valve assembly in the closed positioned as shown in FIG. 1*a;*

The present invention also includes a spill circuit purge device 110 indicated in FIG. 1*a*, but clearly illustrated in FIG. 3. Spill circuit purge device 110 includes a cylinder gas purge passage 112 formed between nozzle valve element 66 and nozzle housing 54 for directing gases from the combustion chamber into spill passage 92 so as to effectively remove spill fuel from spill circuit 82 between injection events when nozzle valve element 66 is in the closed position thus ensuring a more effective spill event during the next injection event resulting in consistent, reliable and more effective injection rate shaping.

Specifically, cylinder gas purge passage 112 includes an annular clearance gap 114 formed between valve surface 102 of nozzle valve element 66 and valve seating surface 104 of nozzle housing 54. Valve surface 102 and valve seating surface 104 are both frusto-conically shaped so that the inner end of nozzle valve element 66 extends into the inner end of nozzle housing 54 in a generally complementary manner as shown in FIG. 3. However, the taper of the frusto-conically shaped valve surface 102 is slightly different than the taper of the frusto-conically shaped valve seating surface 104 so as to cause valve surface 102 abut valve seating surface 104 at a point above injection orifices 68 as shown in FIG. 3. In other words, the angle of inclination of valve surface 102 with respect to the central axis of nozzle valve element 66 is greater than that of the angle of inclination of frusto-conically shaped valve seating surface 104. As a result, a circular line of contact, i.e. a valve seat, 116 is formed between valve surface 102 and valve seating surface 104 upstream of injection orifices 68 forming a seal for preventing fuel flow to spill passage 92 and injection orifices 68 when nozzle valve element 66 is in its closed position as shown in FIG. 3. The included angle seat differential between valve seating surface 104 and valve surface 102 thus forms annular clearance gap 114. Annular clearance gap 114 thus fluidically connects injection orifices 68 with spill passage 92 permitting combustion gas flow into spill circuit 82 between injection events.

The flow of gas from the engine cylinder through annular clearance gap 114 is extremely effective in ensuring a rapid spill event and thus a predictable and reliable reduced injection flow rate during the first portion of the injection event by supplying an adequate quantity of purge gas flow to spill circuit 82 necessary to remove fuel from the circuit. The cleared spill circuit, or void, created by the flow of purge gas in spill circuit 82 greatly improves the spill flow during the next injection event. However, Applicants have found that an excessive purge gas flow through spill circuit 82 creates adverse effects, such as pressurization of the fuel supply tank to which the spill fuel is drained, and overheating of the spill fuel and thus the supply fuel. In addition, an excessive purge gas flow quantity may also result in an accumulation of excessive combustion products, i.e. carbon deposits, in the fuel requiring frequent fuel filter replacement/maintenance. Therefore, the purge gas flow must be restricted to within a maximum predetermined limit to avoid these adverse effects. The air flow area, and thus the quantity of purge gas flow, is determined by the differential angle between valve surface 102 and valve seating surface 104 and the position of the opening of injection orifices 68 along annular clearance gap 114. For a predetermined position of injection orifices 68, as the differential angle between valve surface 102 and valve seating surface 104 is increased, the size of the annular clearance gap 114 also increases to provide greater purge gas flow, and vice versa. As shown in FIG. 3, annular clearance gap 114 increases in size from valve seat 116 inwardly toward the tip of nozzle valve element 66. Thus, for a given differential angle, the purge gas flow quantity can be reduced by forming injection orifices 68 closer to valve seat 116, and increased by forming orifices 68 outwardly toward the tip of nozzle valve element 66 where annular clearance gap 114 creates less of a restriction to the flow of purge gas.

Figure 4A:
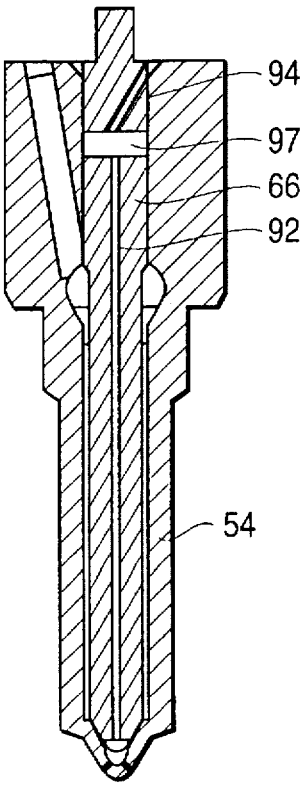
FIG. 4*a* is an enlarged, partial cross-sectional view of an alternative embodiment of the present invention as applied to a mini-sac type injector with the nozzle valve element positioned in the closed position.
Figure 4B:
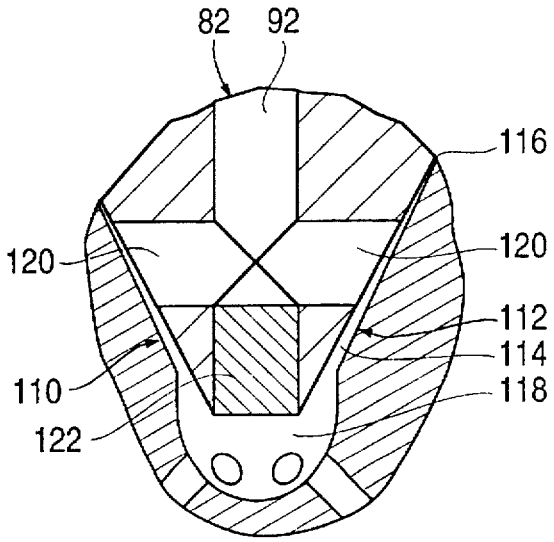
FIG. 4*b* is an exploded, partial cross-sectional view of the tip of the nozzle assembly of FIG. 4*a;*

Referring to FIGS. 4*a* and 4*b*, another embodiment of the present invention is shown wherein the spill circuit purge device 110 is applied to a mini-sac type fuel injector including a reservoir or sac 118 formed in nozzle housing 54. Injection orifices 68 extend through nozzle housing 54 to communicate with the lower portion of sac 118. Spill circuit purge device 110 includes the same purge passage 112 formed by the annular clearance gap 114 as described hereinabove with respect to the embodiment shown in FIG. 3. However, in this embodiment spill circuit 82 includes a plurality of connector passages, i.e. two, extending outwardly from spill passage 92 to communicate with annular clearance gap 114. A sealing plug 122 is securely positioned in the inner end of spill passage 92 to prevent flow through this portion of spill passage 92. As a result, when nozzle valve element 66 is in the closed position as shown in FIG. 4b, cylinder purge gas may flow through injection orifices 68 into annular clearance gap 114 via sac 118 and then into connector passages 120. Thus, the direction of the flow of purge gas through annular clearance gap 114 is now reversed relative to the flow direction of the embodiment of FIG. 3. As described more fully hereinbelow, the purge gas flow rate can be controlled by controlling the size of annular clearance gap 114, the position of the opening of connector passages 120 along annular clearance gap 114, and the size, i.e. diameter, of connector passages 120. It should be noted that in the previous embodiment of FIG. 3, the quantity of purge gas flow is also determined by the size of injection orifices 68. However, the diameter of injection orifices 68 is usually determined by the fuel spray characteristics desired for a particular application. As shown in FIG. 4*a*, spill passage 92 is formed in nozzle valve element 66 by a drilling extending from the inner end of element 66 and terminating at transverse chamber 97.

Figure 5A:
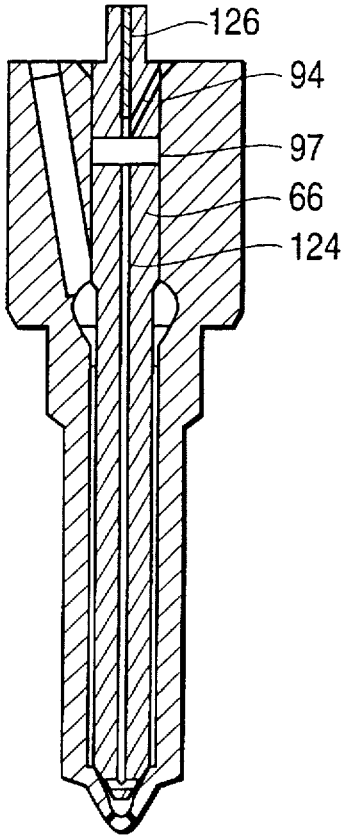
FIG. 5*a* is an enlarged, partial cross sectional view of another embodiment of the rate shaping nozzle assembly of the present invention as applied to a mini-sac type with the nozzle valve element positioned in the closed position.
Figure 5B:
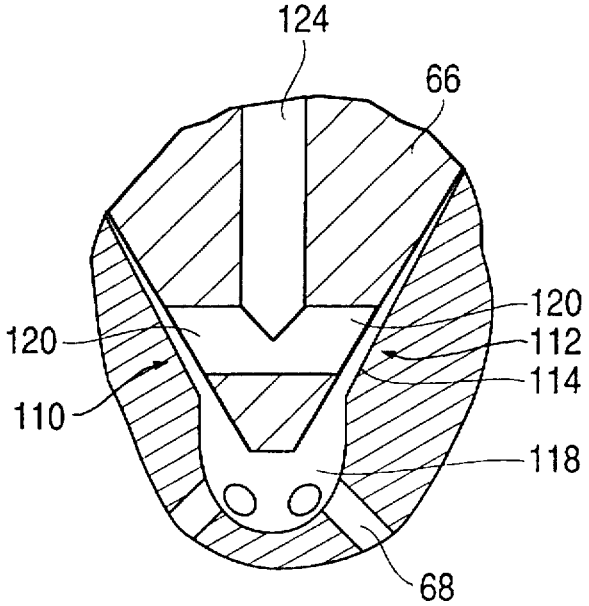
FIG. 5*b* is an exploded, partial cross sectional view of the tip of the nozzle assembly of FIG. 5*a;*

As shown in FIGS. 5*a* and 5*b*, another embodiment of the rate shaping nozzle assembly of the present invention is illustrated which is similar to the embodiment shown in FIGS. 4*a* and 4*b* except that axial spill passage 92 is formed by a drilling extending from the outer end of element 66 and terminating at connector passages 120. A sealing plug 126 is securely positioned in the outer end of spill passage 124 to seal against the flow of fuel and purge gas from the outer end. Consequently, as shown in FIG. 5b, no sealing plug is required at the inner end of element 66. Spill circuit purge device 110 of the present embodiment is the same as discussed previously with respect to the embodiment of FIGS. 4a and 4b.

Figure 6A:
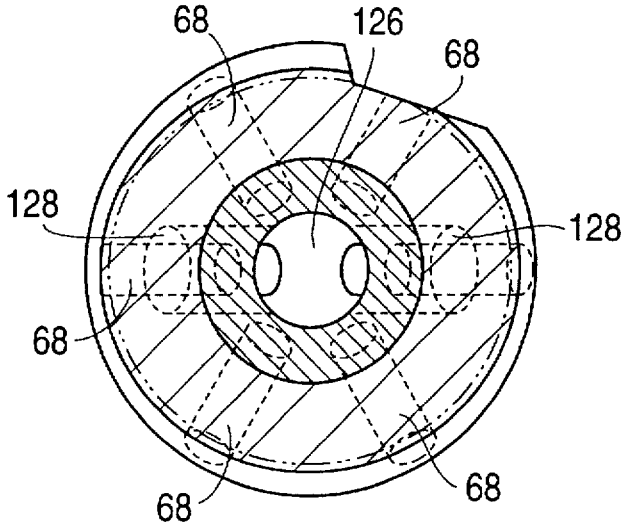
FIG. 6*a* is a cross-sectional view of another embodiment of the present invention of FIG. 6*b* taken along plane 6*a*—6*a;*
Figure 6B:
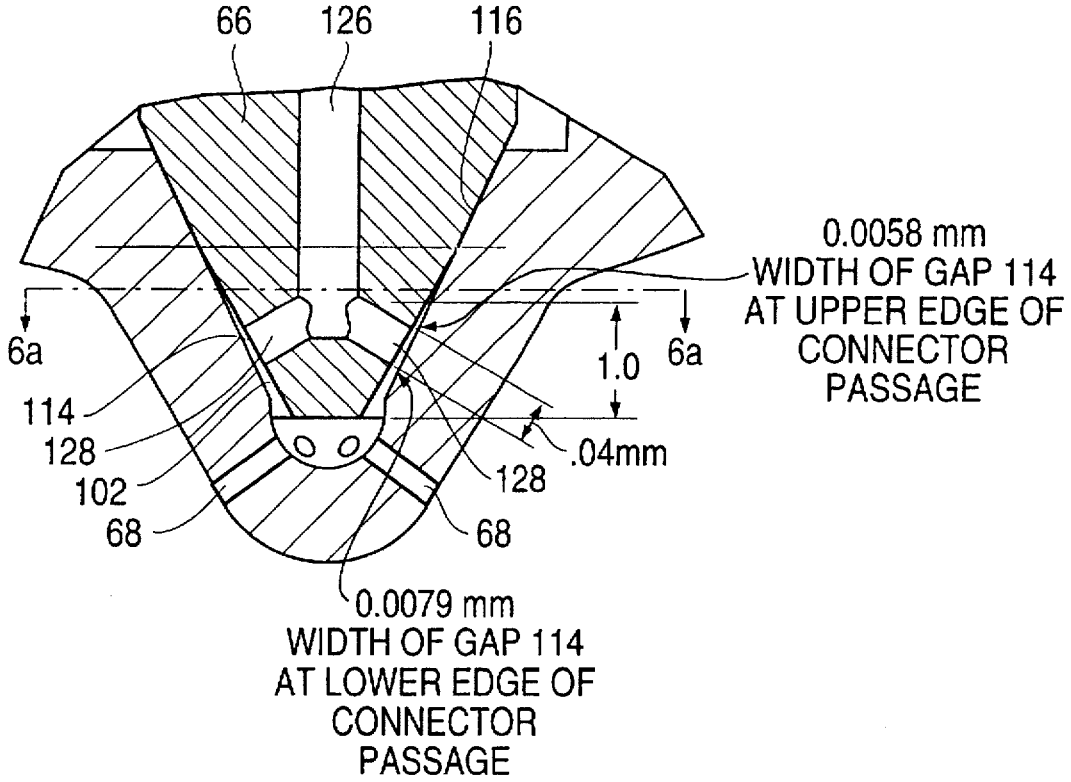
FIG. 6*b* is an exploded, partial cross-sectional view of the present invention shown in FIG. 6*a* with the nozzle valve element in the closed position.
Figure 6C:
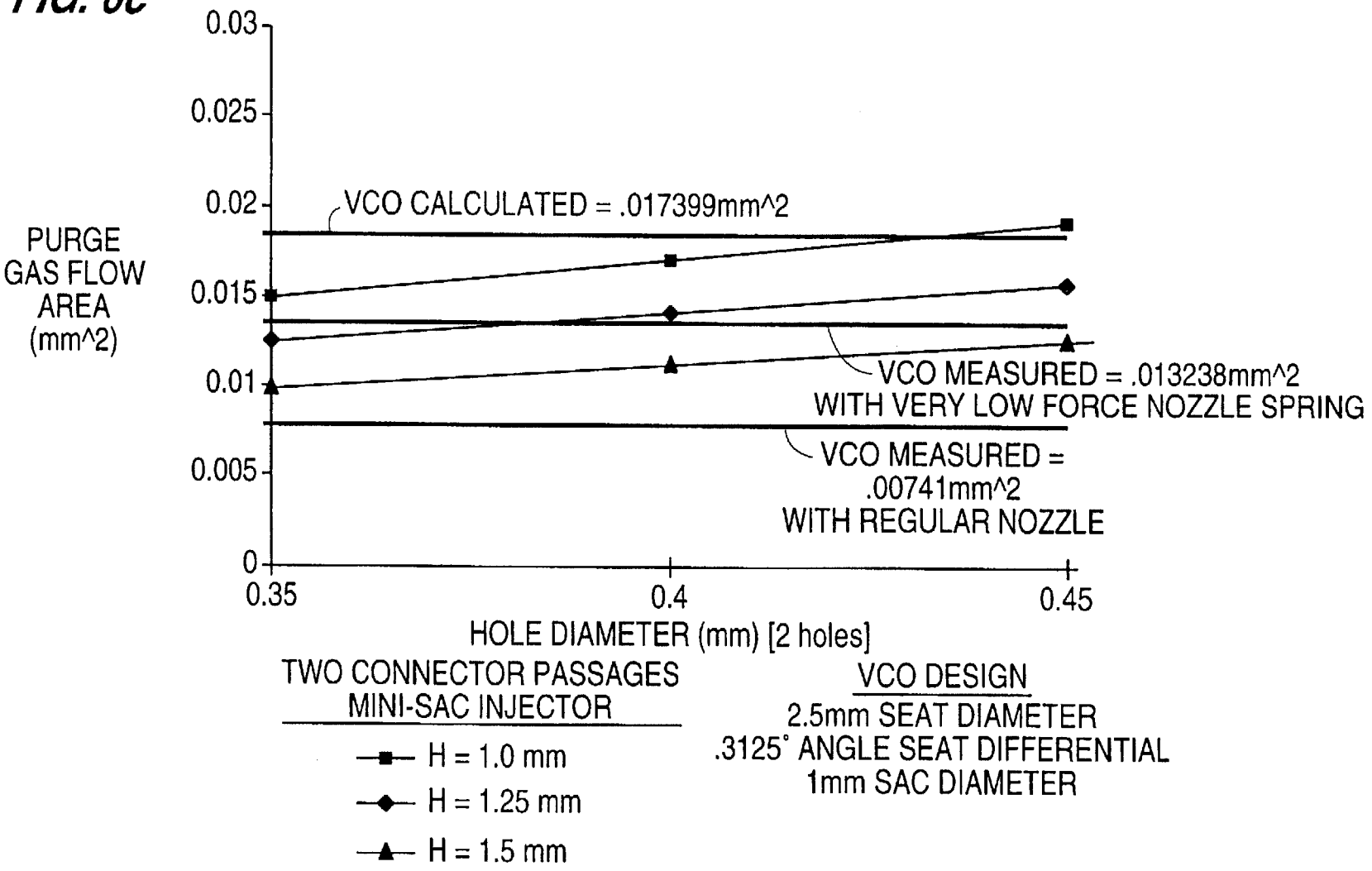
FIG. 6*c* is a graph showing a comparison of the air flow areas for three mini-sac type nozzle assemblies having two connector passages as shown in FIG. 6*a* and 6*b*, wherein each pair of connector passages have different diameters and open at different locations along the element valve surface, and calculated and measured air flow areas for the VCO nozzle design of FIG. 3.

FIGS. 6a and 6b illustrate yet another embodiment of the present invention which is similar to the embodiment of FIGS. 5a and 5b except that spill circuit 82 includes connector passages 128 which extend from the inner end of spill passage 126 at an angle toward valve surface 102. As shown in FIG. 6a, this embodiment includes two connector passages 128 along with six injection orifices 68. Like the previous embodiment, the purge gas flow rate is determined primarily by the purge gas flow area. Assuming a predetermined angle seat differential for given arrangement, the purge gas flow area, and thus the purge gas flow rate, for a given set of combustion chamber operating conditions, is determined by the position of the opening of the connector passage along annular clearance gap 114 and by the diameter of connector passages 128. FIG. 6c illustrates the effects of varying the diameter of the connector passages and the position of the connector passages along annular clearance gap 114, on the purge gas flow area. As can be seen, as the position of the opening of connector passage 128 is moved outwardly along annular clearance gap 114 toward valve seat 116, that is, when H is increased (where H equals the distance between the inner end of nozzle valve element 66 and the intersection of the central longitudinal axis of element 66 and the central axis of connector passage 128), the purge gas flow area decreases as a result of the decreasing annular clearance gap 114. Also, for a given connector passage position, i.e. H=1.25, the purge gas flow area increases as the diameter of connector passages 128 increases. Thus, a certain combination of connector passage diameter and position can be chosen to achieve the desired purge gas flow area resulting in an optimum purge gas flow quantity or rate. The graph of FIG. 6c also illustrates the purge gas flow area for a VCO type injector nozzle as disclosed in FIG. 3 as calculated based on flow area dimensions and also measured based on test results for assemblies having both a very low force nozzle spring and a conventional nozzle spring force. The nozzle spring force acting on nozzle valve element 66 deforms the wall of nozzle housing 54 slightly inwardly toward valve surface 102 so as to decrease the width of annular clearance gap 114 and thus reduce the purge gas flow area. Thus, the larger the biasing force of nozzle spring 70 (FIG. 1a), the greater the decreasing effect on the annular clearance gap and thus the purge gas flow area.

Figure 7A:
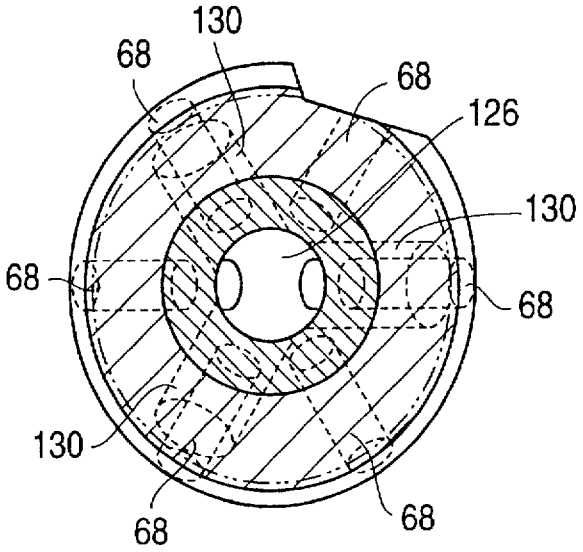
FIG. 7*a* is a cross-sectional view of another embodiment of the present invention of FIG. 7*b* taken along plane 7*a*—7*a;*
Figure 7B:
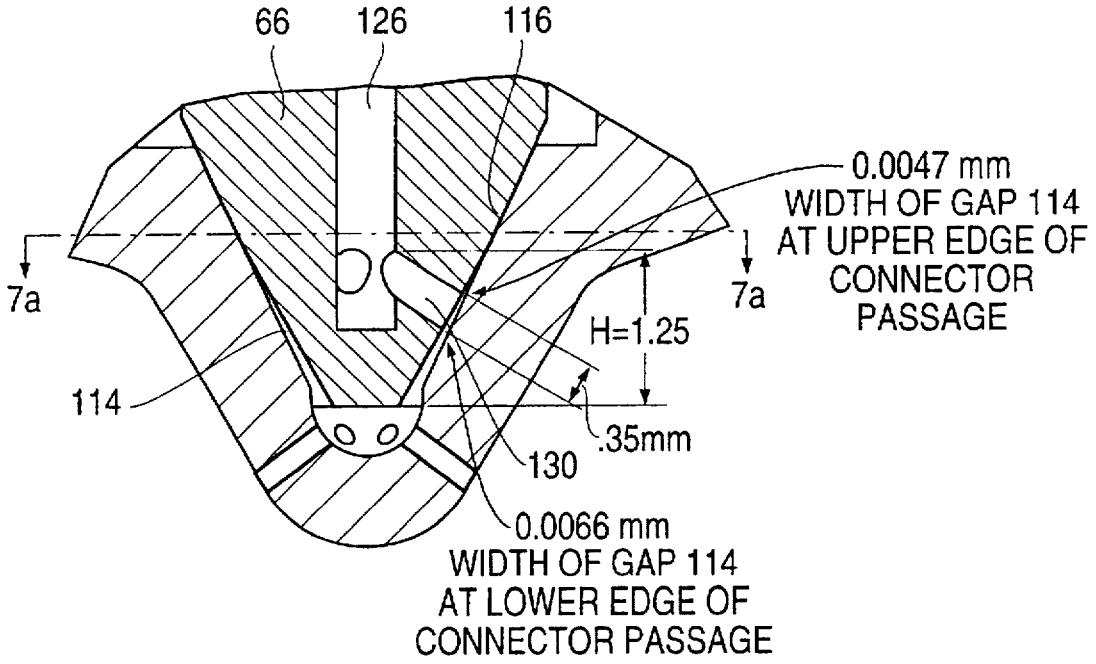
FIG. 7*b* is an exploded, partial cross-sectional view of the present invention as shown in FIG. 7*a* with the nozzle valve element in the closed position.
Figure 7C:
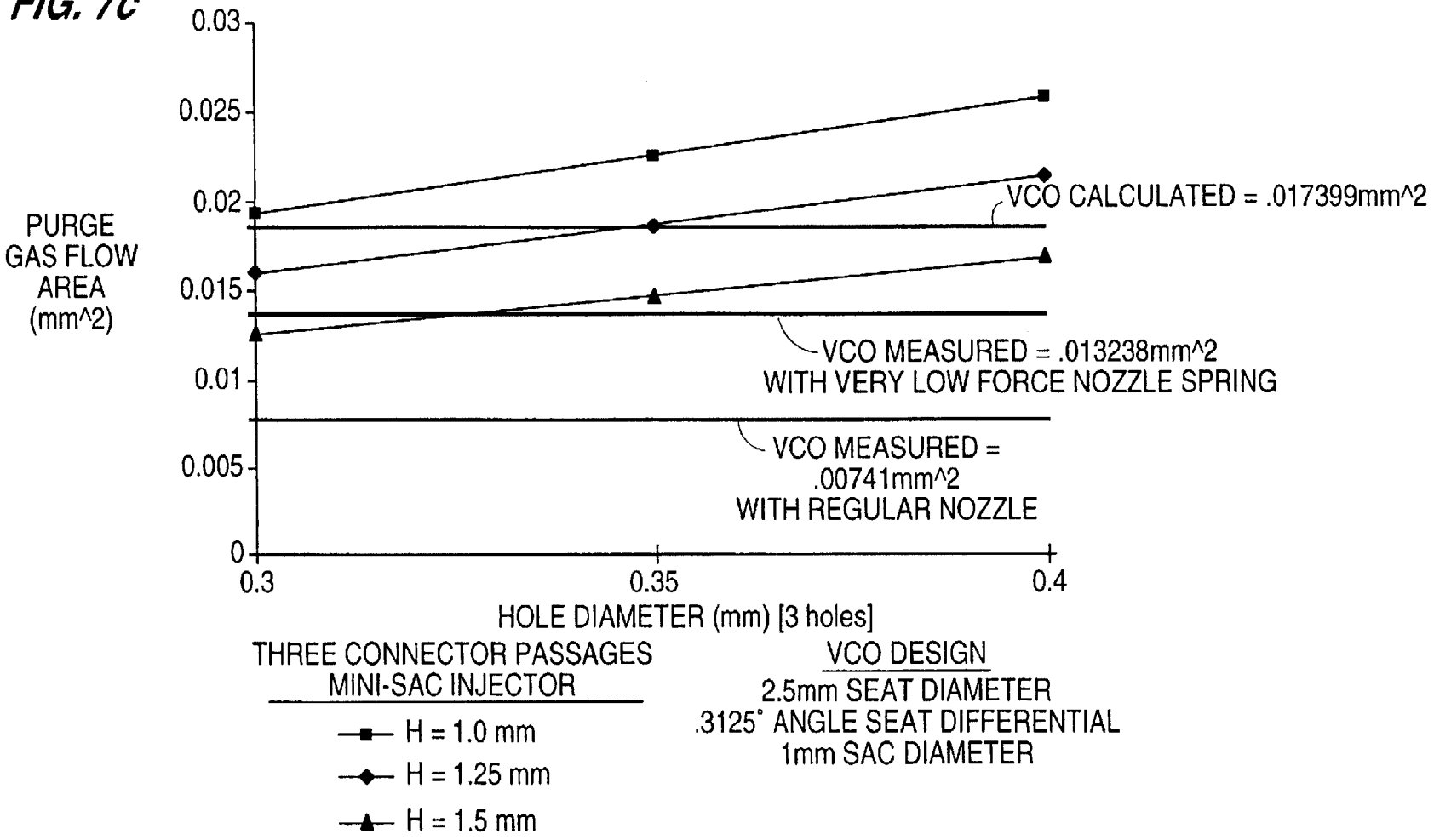
FIG. 7*c* is a graph showing a comparison of the air flow areas for three mini-sac type nozzle assemblies having three connector passages as shown in FIG. 7*a* and 7*b*, wherein the connector passages have different diameters and open at different locations along the element valve surface, and calculated and measured air flow areas for the VCO nozzle design of FIG. 3.

FIGS. 7a and 7b illustrate yet another embodiment of the rate shaping nozzle assembly of the present invention which is the same as the embodiment shown in FIGS. 6a–6b, except that spill circuit 82 includes three connector passages 130 equally spaced around the circumference nozzle valve element 66 as specifically shown in FIG. 7a. Like the previous embodiment, the diameter of the openings of connector passages 130 in valve surface 102 and the position of the connector passage openings along annular clearance gap 114, can be predetermined to achieve a desired purge gas flow area corresponding to a desired purge gas flow rate. FIG. 7c illustrates the effects of the size and positioning of the connector passages 130 on the air flow area. Comparing FIGS. 6c and 7c, it is clear that a nozzle assembly having three connector passages results in a larger air flow area than the two connector passage design of FIGS. 6a and 6b, for a given connector passage position and diameter. However, different combinations of connector passage diameters and positions can be chosen to achieve a similar air flow area for the two passage and three passage arrangements.

Figure 8A:
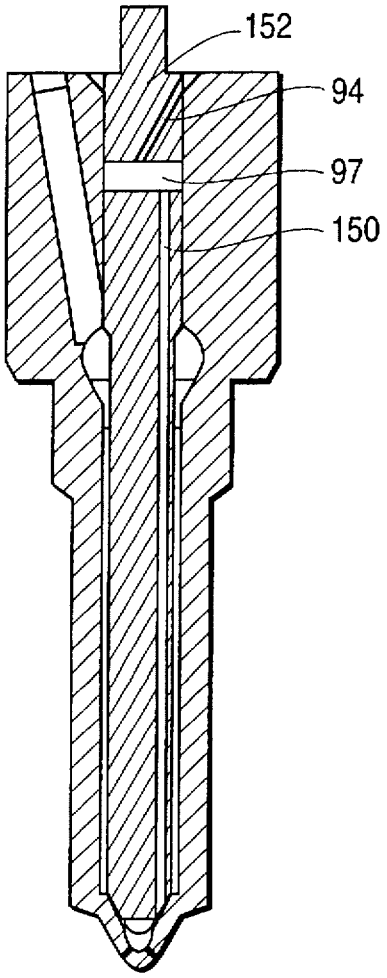
FIG. 8*a* is an enlarged, partial cross sectional view of another embodiment of the rate shaping nozzle assembly of the present invention with the nozzle valve element positioned in the closed position.
Figure 8B:
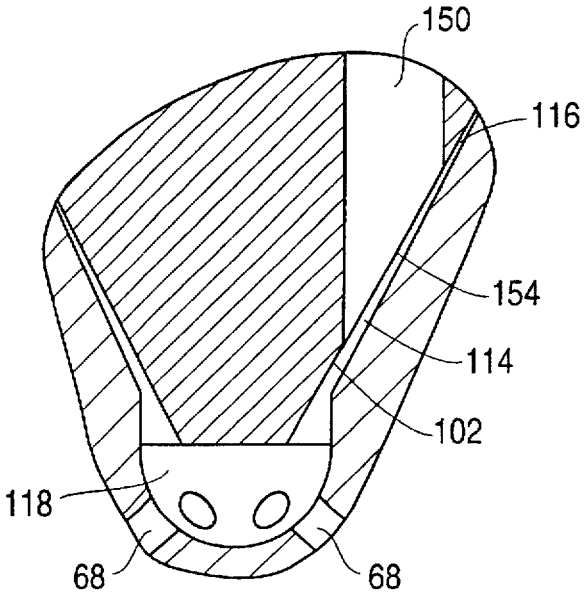
FIG. 8*b* is an exploded, partial cross sectional view of the tip of the nozzle assembly of FIG. 8*a;*

FIGS. 8a and 8b illustrate another embodiment of the present rate shaping nozzle assembly including the cylinder gas purge passage 112 in the form of the annular clearance gap 114 discussed hereinabove with respect to the previous embodiments. However, in this mini-sac application, the connector passages discussed hereinabove with respect to the previous mini-sac embodiments, are avoided by forming an axial spill passage 150 offset a spaced distance from the center line of nozzle valve element 152. Axial spill passage 150 is formed from the inner end of nozzle valve element 152 and terminates in the outer portion at transverse chamber 97. The inner end of spill passage 150 forms an opening 154 in valve surface 102. Thus, no additional connector passages are needed to connect spill passage 150 to annular clearance gap 114. With the valve element 152 in the closed position as shown in FIGS. 8a and 8b, cylinder purge gas flows through injector orifices 68 into mini-sac 118, through annular clearance gap 114 and into axial spill passage 150. When nozzle valve element 150 moves into an open position, annular valve seat 116 will open allowing fuel to flow through the annular gap between nozzle valve element 150 and nozzle housing 54. As discussed hereinabove, fuel will spill into axial passage 150 during the initial portion of the injection event while also flowing into mini-sac 118 and through orifices 68 into the combustion chamber. The description of the rate shaping capability of the present embodiment is the same as that discussed hereinabove with respect to the embodiment of FIGS. 1a and 1b. Also, the flow of purge gas is determined by the size of annular clearance gap 114 i.e. the included angle seat differential, the position of the opening 154 of axial passage 150 and the size of opening 154.

Figure 9A:
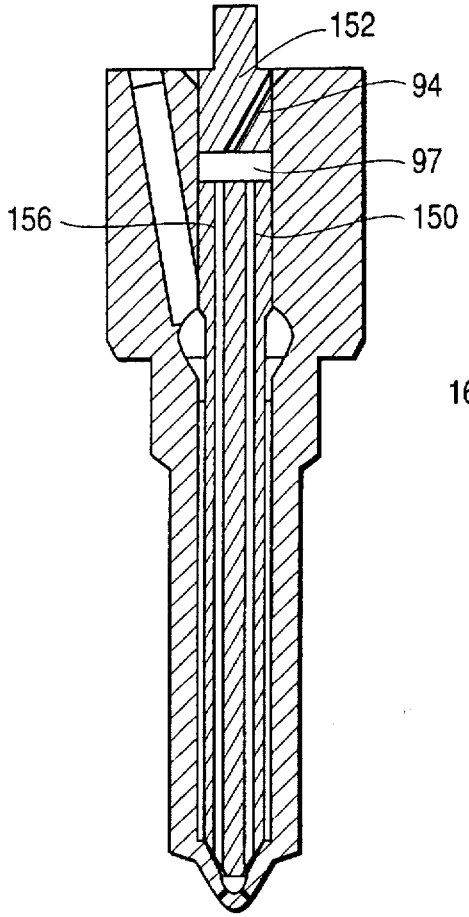
FIG. 9*a* is an enlarged, partial cross sectional view of yet another embodiment of the rate shaping nozzle assembly of the present invention with the nozzle valve element positioned in the closed position.
Figure 9B:
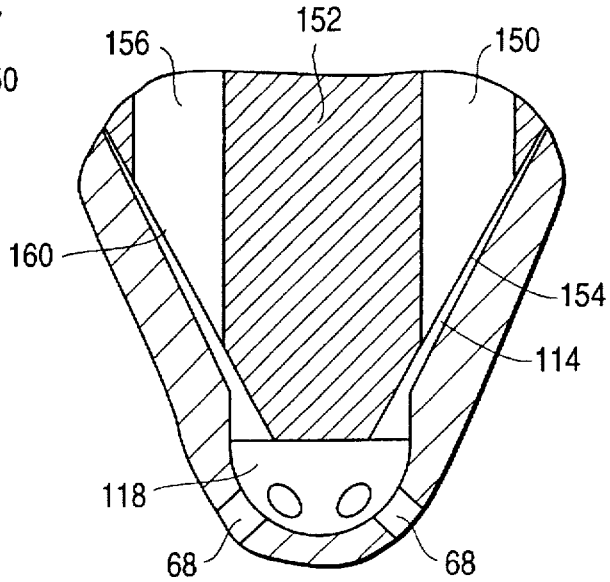
FIG. 9*b* is an exploded, partial cross sectional view of the tip of the nozzle assembly of FIG. 9*a;*

FIGS. 9a and 9b disclose yet another embodiment of the present invention which is the same as the embodiment described hereinabove with respect to FIGS. 8a and 8b, except for the addition of a second axial spill passage 156 offset a spaced distance from the center line of nozzle valve element 152. Axial spill passage 156 likewise connects transverse chamber 97 to annular clearance gap 114 and forms an opening 160 in valve surface 102. The use of two axial spill passages 150 and 156 permits greater control over the purge gas flow area than the previous single axial spill passage embodiment of FIGS. 8a and 8b due to the difficulty in controlling the tolerances of a single opening and clearance gap flow area.

Figure 10:
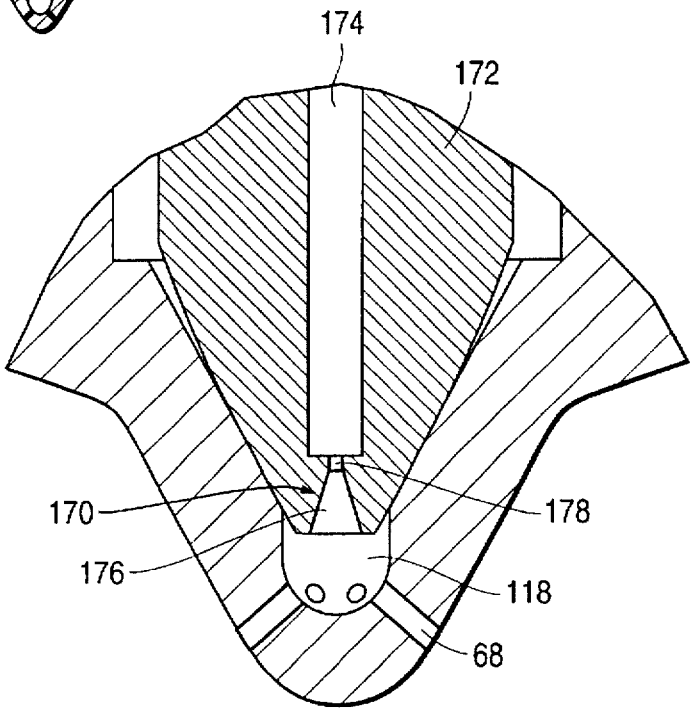
FIG. 10 is an exploded, partial cross sectional view of the tip of the nozzle assembly of still another embodiment of the present invention with the nozzle valve element positioned in the closed position.

FIG. 10 represents another embodiment of the present rate shaping nozzle assembly including a spill circuit purge device 170 integrally formed in a nozzle valve element 172. As shown in combination with a mini-sac type nozzle housing, an axial spill passage 174 extends longitudinally through nozzle valve element 172 to communicate with spill circuit purge device 170 at its innermost end. Spill circuit purge device 170 includes a purge passage 176 extending from the inner end of spill passage 174 through nozzle valve element 172 to communicate with mini-sac 118. purge passage 176 includes a restriction orifice 178 having a predetermined purge gas flow area for restricting the flow of purge gas between injection events. Therefore, orifice 178 functions in a similar manner to the annular clearance gap 114 discussed hereinabove with respect to the previous embodiments. However, the size of restriction orifice 178 can be more easily controlled during manufacture permitting more predictable control over the purge gas flow. On the other hand, purge passage 176 also functions as an integral part of the spill circuit, i.e. spill passage 174, and thus all spill flow must pass through restriction orifice 178. As a result, the desired spill flow rate and thus rate shaping capability of the assembly must be considered in the selection of the appropriate size of restriction orifice 178 so as not to compromise the rate shaping ability of the assembly.

Figure 11:
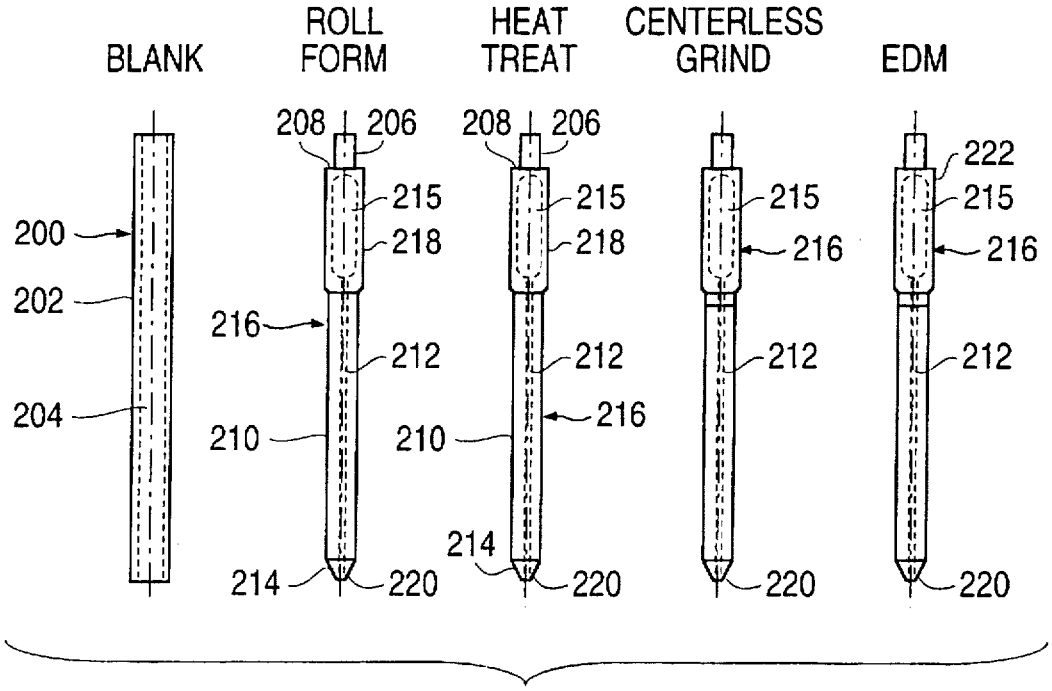
FIG. 11 is a schematic of one embodiment of the method of the present invention for forming a nozzle valve element having an axial center spill passage from a tube which shows the nozzle valve element after each forming step.
Figure 12:
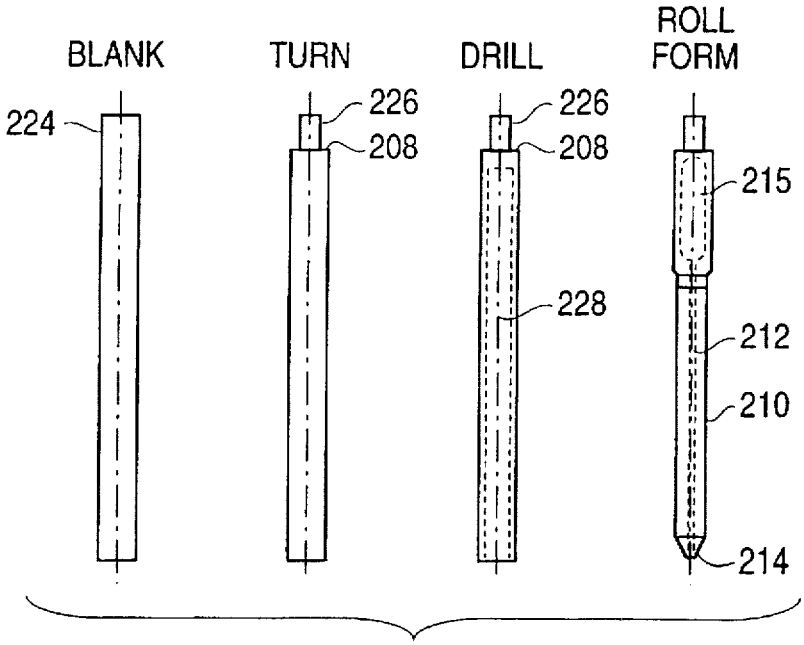
FIG. 12 is a schematic of another embodiment of the method of the present invention for forming a nozzle valve element having an axial center spill passage from a solid rod which shows the nozzle valve element after each forming step.
Figure 13:
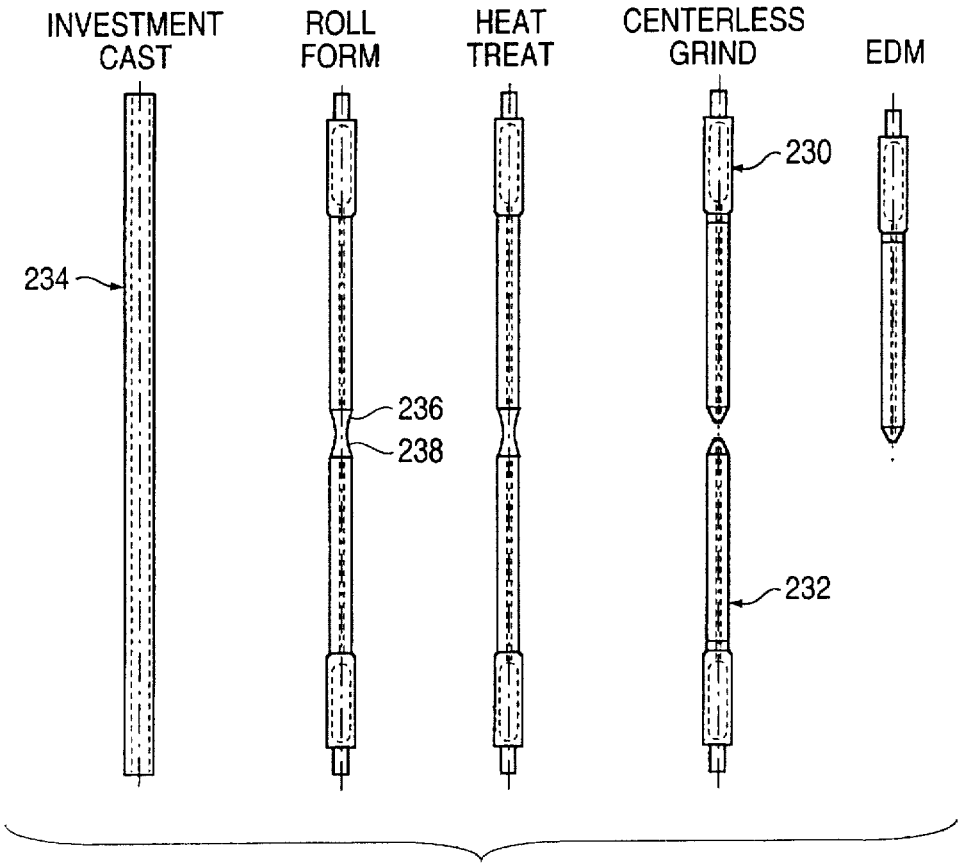
FIG. 13 is a schematic of yet another embodiment of the method of the present invention for forming multiple nozzle valve elements, having an axial center spill passages, from a single piece of tube, which shows the nozzle valve elements after each forming step.

FIGS. 11–13 illustrate an improved method of the present invention for forming the nozzle valve element for use with the rate shaping nozzle assembly of the present invention. As shown in FIG. 11, the method of the present invention includes a step of providing a tube 200 having a generally cylindrical outer surface 202 and an axial center passage 204 extending therethrough. A compressive force is then applied to the outer surface of tube 200 by, for example, a conventional cold or warm forging process, i.e. roll forming, so as to reduce the initial diameter of outer surface 202 along preselected portions of tube 200. Specifically, an outer end 206 of tube 200 is compressed to a smaller diameter to form an annular step 208 which comprises a portion of the spill valve 86 discussed with respect to the first embodiment of FIGS. 1*a* and 1*b*. The compression of outer end 206 substantially closes the outer end of axial center passage 204. Tube 200 is also compressed along a significant portion of its length, indicated at 210, corresponding to the length of an axial spill passage 212. Tube 200 is compressed along length 210 a predetermined amount until the diameter of axial center passage 204 has been reduced to the final desired diameter of spill passage 212. An end portion of tube 200 is compressed even further so as to form angled valve seat portion 214. As a result, the inner end of axial center passage 204 is substantially closed. A central portion 218 of tube 200 is not subjected to the roll forming forces so as to maintain the outer diameter of the tube along portion 218 while creating an accelerating chamber 215. The result of theses two steps is a partially completed nozzle valve element 216. Nozzle valve element 216 is then heat treated in a conventional manner to relieve stresses and impart the required strength and hardness properties to the material. Nozzle valve element 216 is then subjected to a centerless grinding operation which finishes the exterior surface to ensure proper outer diameters are achieved while forming an effective valve seat surface 220 on valve seat portion 214. The inner end of axial spill passage 212 is then reopened by drilling or electrical discharge machining an axial passage in the inner end of valve seat portion 214. Also, a lateral passage 222 is formed by, for example, electrical discharge machining in central portion 218 so as to communicate with accelerating chamber 215.

Tube 200 is selected with an initial predetermined outer diameter and an initial predetermined inner diameter forming axial center passage 204 which are specifically sized so as to permit the effective formation of spill passage 212, section 206 and valve seat portion 214 upon the application of respective predetermined amounts of compressive force to outer surface 202. In addition, the outer diameter of tube 200 is chosen to correspond to the diameter of the guide bore of the nozzle housing so that the grinding step can effectively create the desired clearances necessary for a substantially sealed, slidable interface, if necessary. Also, the diameter of axial center passage 204 is chosen to correspond to the desired diameter of accelerating chamber 215. This method allows tube 200 to be easily mass produced by any conventional process, for example, casting or extruding, thus minimizing the cost and difficulty associated with forming nozzle valve element 216 by conventional methods. Conventionally, the formation of spill passage 212 is extremely tedious and difficult due to the minimal size of both element 216 and passage 212. The present method provides an inexpensive yet effective alternative to conventional machining methods.

FIG. 12 illustrates another embodiment of the method of the present invention for forming nozzle valve element 216. In this embodiment, a solid cylindrical rod 224 is provided which includes an outer predetermined diameter. An outer end 226 is worked or turned to form annual step 208. An axial center passage 228 is then formed from the inner end of rod 224 so as to terminate prior to the outer end 226. The hollow rod is then subjected to compressive forces, i.e. roll forming, along portion 210 and valve seat portion 214 to form axial spill passage 212 and close off the inner end of passage 212 as discussed hereinabove with respect to the embodiment of FIG. 11. However, this embodiment does not require roll forming the outer end 226. This embodiment ensures that all spill fuel is directed solely through lateral passage 222 thus avoiding any leakage through the outer end of the nozzle valve element of the previous embodiment in the event the outer end of the center passage is inadequately closed by compression, thus ensuring proper fuel spilling and effective rate shaping. After roll forming, nozzle valve element 216 is then heat treated, centerless ground and electrical discharge machined as described in the embodiment of FIG. 11.

FIG. 13 illustrates yet another embodiment of the present method for forming nozzle valve elements to be used with the rate shaping nozzle assembly of the present invention which effectively produces two nozzle valve elements 230 and 232 for each piece of tube 234. The present embodiment is substantially the same as the embodiment of FIG. 11 except that tube 234 is provided with a predetermined length substantially corresponding to the combined length of the two nozzle valve elements 230 and 232. Nozzle valve elements 230 and 232 are formed such that the respective valve seat portions 234 and 236, respectively, are positioned adjacent one another. As a result, a single portion of a compressive force producing machine, i.e. rollers, can be applied to a single portion of tube 232 to form both valve seat portions 234 and 236 in a single forming step thus decreasing the cost and time of the manufacturing process.

Figure 14:
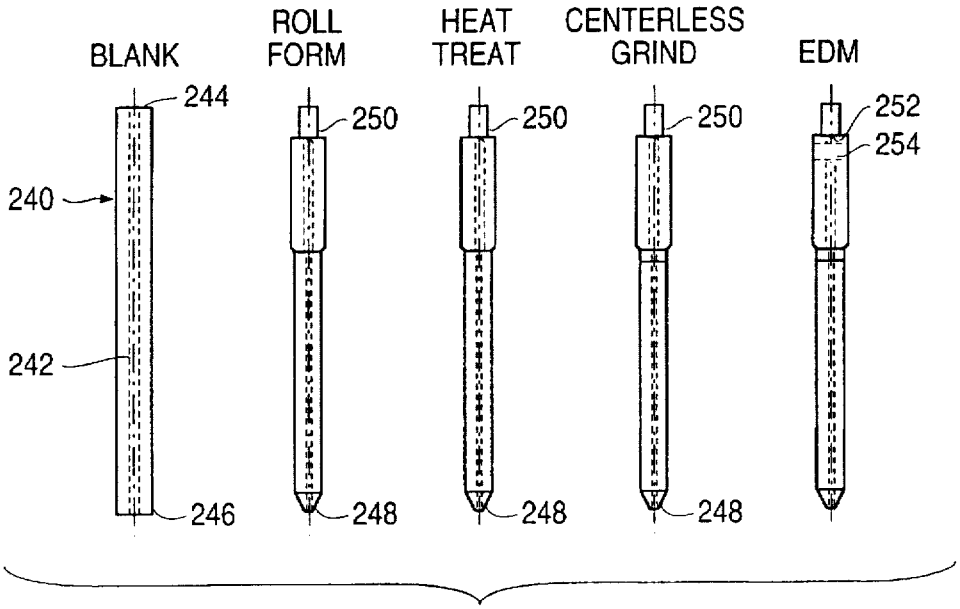
FIG. 14 is a schematic of still another embodiment of the method of the present invention for forming a nozzle valve element having an axial center spill passage from a tube which shows the nozzle valve element after each forming step.

FIG. 14 is directed to yet another embodiment of the present method for forming the rate shaping nozzle valve element of the present invention. In this embodiment, a tube 240 is provided with an axial center passage 242 having a predetermined diameter corresponding to the desired diameter of the resulting spill passage. The outer end 244 and the inner valve seat end portion 246 are roll formed as discussed hereinabove with respect to the embodiment of FIG. 11 so as to form the conical valve seat portion 248 and to close off the outer end of spill passage 242 while forming annular step 250. The nozzle valve element may then be heat treated and centerless ground as discussed hereinabove. The inner end of spill passage 242 is then reopened by electrical discharge machining and a lateral spill passage 252 formed as discussed hereinabove. In addition, a transverse accelerating chamber 254 may then be formed in the nozzle valve element. It should be noted that the previous embodiments of the present method as discussed hereinabove with respect to FIGS. 11–13 may also include a transverse accelerating chamber in lieu of, or in addition to, the disclosed axial accelerating chamber 215.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection rate control by a simple rate control device in order to minimize emissions. Such internal combustion engines including a fuel injector in accordance with the present invention can be widely used in all industrial fields and non-commercial applications, including trucks, passenger cars, industrial equipment, stationary power plant and others.

We claim:

1. A closed nozzle fuel injector adapted to inject fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice and a low pressure drain circuit for draining fuel from said injector cavity;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

a rate shaping control means for producing a predetermined time varying change in the flow rate of fuel injected into the combustion chamber during said injection event to create a low injection flow rate through said injector orifice followed by a high injection flow rate greater than said low injection flow rate during said injection event, said rate shaping control means including an injection spill circuit for spilling a portion of the fuel to be injected from said fuel transfer circuit to said low pressure drain circuit during said injection event to create said low injection flow rate;

a spill circuit purge means for providing a flow of purge gas through said injection spill circuit so as to remove fuel from said injection spill circuit, said spill circuit purge means capable of restricting the flow of purge gas to ensure sufficient fuel removal from said injection spill circuit while avoiding excessive purge gas flow.

2. The closed nozzle fuel injector of claim 1, wherein said spill circuit includes a spill passage formed in said nozzle valve element, said spill circuit purge means including a cylinder gas purge passage for directing cylinder gas from the combustion chamber of the engine into said spill passage.

3. The closed nozzle fuel injector of claim 2, wherein said cylinder gas purge passage is formed between said nozzle valve element and said injector body for directing cylinder gas from said injector orifice to said spill passage, said purge passage being sized, when said nozzle valve element is in said closed position, to restrict the purge gas flow to achieve a predetermined optimum purge gas flow.

4. The closed nozzle fuel injector of claim 2, wherein said valve element includes an inner portion having a frustoconically shaped valve surface, said injector body including a nozzle housing having a frustoconically shaped seating surface facing said valve surface, said seating surface and said valve surface extending at different angles in a nonparallel relationship, said cylinder gas purge passage including an annular clearance gap formed between said seating surface and said valve surface by the nonparallel relationship and sized, when said nozzle valve element is in said closed position, to restrict the purge gas flow to achieve a predetermined optimum purge gas flow.

5. The closed nozzle fuel injector of claim 2, wherein said nozzle valve element includes an inner portion positioned adjacent said injector orifice and an outer portion positioned a spaced distance from said inner portion, said spill passage including at least one axial passage extending longitudinally from said inner portion to said outer portion.

6. The closed nozzle fuel injector of claim 5, wherein said spill passage further includes a plurality of connector passages extending from said at least one axial passage through said inner portion of said nozzle valve element to communicate with said cylinder gas purge passage.

7. The closed nozzle fuel injector of claim 6, wherein said plurality of connector passages include three passages evenly spaced around said nozzle valve element.

8. The closed nozzle fuel injector of claim 6, wherein said plurality of connector passages extend perpendicular to said at least one axial spill passage.

9. The closed nozzle fuel injector of claim 6, wherein said injection spill circuit further includes a transverse chamber extending through said outer portion of said nozzle valve element, wherein said at least one axial passage includes an outer end terminating at said transverse passage and an inner end, further including a sealing plug positioned in said inner end adjacent said plurality of connector passages.

10. The closed nozzle fuel injector of claim 6, wherein said at least one axial passage includes an inner end terminating at said plurality of connector passages and an outer end, further including a sealing plug positioned in said outer end of said at least one axial passage.

11. The closed nozzle fuel injector of claim 5, wherein said at least one axial passage is positioned a spaced transverse distance from a central longitudinal axis of said nozzle valve element.

12. The closed nozzle fuel injector of claim 5, wherein said at least one axial passage includes two axial passages, each positioned a respective spaced transverse distance from a central longitudinal axis of said nozzle valve element.

13. The closed nozzle fuel injector of claim 11, wherein said inner portion of said valve element includes an valve surface, said injector body including a nozzle housing having a seating surface facing said valve surface, said at least one axial passage including an inner end forming an opening in said valve surface of said inner portion for directly communicating with said cylinder gas purge passage.

14. The closed nozzle fuel injector of claim 2, wherein said cylinder gas purge passage includes an orifice passage positioned in an inner portion of said nozzle valve element, said orifice passage providing communication between an inner end of said spill passage and a fuel reservoir formed in said injector body adjacent said injector orifice.

15. The closed nozzle fuel injector of claim 1, wherein said spill circuit includes a spill passage integrally formed in said nozzle valve element.

16. The closed nozzle fuel injector of claim 1, wherein said nozzle valve element blocks fuel flow through said spill circuit when positioned in said closed position.

17. The closed nozzle fuel injector of claim 1, wherein said rate shaping control means further includes a spill valve means for controlling the spill flow of fuel through said spill circuit to create said high injection flow rate.

18. The closed nozzle injector of claim 17, wherein said spill valve means includes an annular step integrally formed on said nozzle valve element and an annular valve seat formed on said injector body for sealing engagement by said annular step upon movement of said nozzle valve element into said open position to prevent spill flow through said spill circuit.

19. The closed nozzle injector of claim 1, wherein said rate shaping control means further includes a spill accelerating means positioned along said spill circuit for creating a rapid increase in the spill flow rate during each injection event.

20. The closed nozzle fuel injector of claim 19, wherein said spill circuit includes an axial passage and said spill accelerating means includes a transverse spill chamber formed in said nozzle valve element and extending generally transverse to said axial passage for receiving spill fuel from said spill passage.

21. The closed nozzle fuel injector of claim 19, wherein said rate shaping control means further includes a flow limiting orifice positioned in said spill circuit for limiting the spill flow through said spill passage to a predetermined maximum spill flow rate, said flow limiting orifice being formed at least partially by said nozzle valve element and positioned along said spill circuit downstream of said spill accelerating means.

22. The closed nozzle fuel injector of claim 17, wherein said spill circuit includes a spill passage formed in said nozzle valve element, said nozzle valve element further including an outer portion positioned a spaced distance from said inner portion, said spill passage including at least one axial passage extending longitudinally from said inner portion to said outer portion.

23. The closed nozzle fuel injector of claim 17, wherein said valve surface of said inner portion of said nozzle valve element and said seating surface of said nozzle housing are both frusto-conically shaped.

24. The closed nozzle fuel injector of claim 22, wherein said spill passage further includes a plurality of connector passages extending from said at least one axial passage through said inner portion of said nozzle valve element to communicate with said cylinder gas purge passage.

25. The closed nozzle fuel injector of claim 24, wherein said plurality of connector passages include three passages evenly spaced around said nozzle valve element.

26. The closed nozzle fuel injector of claim 24, wherein said plurality of connector passages extend perpendicular to said at least one axial spill passage.

27. The closed nozzle fuel injector of claim 24, wherein said injection spill circuit further includes a transverse chamber extending through said outer portion of said nozzle valve element, wherein said at least one axial passage includes an outer end terminating at said transverse passage and an inner end, further including a sealing plug positioned in said inner end adjacent said plurality of connector passages.

28. The closed nozzle fuel injector of claim 24, wherein said at least one axial passage includes an inner end terminating at said plurality of connector passages and an outer end, further including a sealing plug positioned in said outer end of said at least one axial passage.

29. The closed nozzle fuel injector of claim 22, wherein said at least one axial passage is positioned a spaced transverse distance from a central longitudinal axis of said nozzle valve element.

30. The closed nozzle fuel injector of claim 29, wherein said at least one axial passage includes an inner end forming an opening in said valve surface of said inner portion for directly communicating with said cylinder gas purge passage.

31. The closed nozzle fuel injector of claim 24, wherein said at least one axial passage includes two axial passages, each positioned a respective spaced transverse distance from a central longitudinal axis of said nozzle valve element.

32. A closed nozzle fuel injector adapted to inject fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice, a low pressure drain circuit for draining fuel from said injector cavity and a nozzle housing having a seating surface;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber, said nozzle valve element including an inner portion having a valve surface facing said seating surface, said seating surface and said valve surface extending at different angles in a nonparallel relationship;

a rate shaping control means for producing a predetermined time varying change in the flow rate of fuel injected into the combustion chamber during said injection event to create a low injection flow rate through said injector orifice followed by a high injection flow rate greater than said low injection flow rate during said injection event, said rate shaping control means including an injection spill circuit for spilling a portion of the fuel to be injected from said fuel transfer circuit to said low pressure drain circuit during said injection event to create said low injection flow rate;

a spill circuit purge means for providing a flow of purge gas through said injection spill circuit so as to remove fuel from said injection spill circuit, said spill circuit purge means including a cylinder gas purge passage for directing cylinder gas from the combustion chamber of the engine into said injection spill circuit, said cylinder gas purge passage including an annular clearance gap formed between said seating surface and said valve surface by the nonparallel relationship and sized, when said nozzle valve element is in said closed position, to restrict the purge gas flow to ensure sufficient fuel removal from said injection spill circuit while avoiding excessive purge gas flow.

33. The closed nozzle fuel injector of claim 32, wherein said spill circuit includes a spill passage integrally formed in said nozzle valve element.

34. The closed nozzle fuel injector of claim 32, wherein said nozzle valve element blocks fuel flow through said spill circuit when positioned in said closed position.

35. The closed nozzle fuel injector of claim 32, wherein said rate shaping control means further includes a spill valve means for controlling the spill flow of fuel through said spill circuit to create said high injection flow rate.

36. The closed nozzle injector of claim 35, wherein said spill valve means includes an annular step integrally formed on said nozzle valve element and an annular valve seat formed on said injector body for sealing engagement by said annular step upon movement of said nozzle valve element into said open position to prevent spill flow through said spill circuit.

37. The closed nozzle injector of claim 32, wherein said rate shaping control means further includes a spill accelerating means positioned along said spill circuit for creating a rapid increase in the spill flow rate during each injection event.

38. The closed nozzle fuel injector of claim 37, wherein said spill circuit includes an axial passage and said spill accelerating means includes a transverse spill chamber formed in said nozzle valve element and extending generally transverse to said axial passage for receiving spill fuel from said spill passage.

39. The closed nozzle fuel injector of claim 37, wherein said rate shaping control means further includes a flow limiting orifice positioned in said spill circuit for limiting the spill flow through said spill passage to a predetermined maximum spill flow rate, said flow limiting orifice being formed at least partially by said nozzle valve element and positioned along said spill circuit downstream of said spill accelerating means.

* * * * *